US006123285A

United States Patent [19]

Border et al.

[11] Patent Number: 6,123,285

[45] Date of Patent: Sep. 26, 2000

[54] EXPANDABLE FIBER CORE INSERT

[75] Inventors: Jerry K. Border, Bourbon; Daryl L. Overmeyer, Warsaw, both of Ind.

[73] Assignee: R. R. Donnelley & Sons Company, Chicago, Ill.

[21] Appl. No.: 08/935,981

[22] Filed: Sep. 23, 1997

Related U.S. Application Data

[60] Provisional application No. 60/025,764, Sep. 23, 1996.

[51] Int. Cl.[7] ..... B65H 75/24

[52] U.S. Cl. ..... 242/571.4; 242/573.1; 279/2.02; 492/21

[58] Field of Search ..... 242/571, 571.3, 242/571.4, 572, 573, 573.1; 279/2.02, 2.03, 2.04; 492/21

[56] References Cited

U.S. PATENT DOCUMENTS

| | | | |
|---|---|---|---|
| 2,075,192 | 3/1937 | George . | |
| 2,431,961 | 12/1947 | Phillips et al. | 279/2.02 |
| 2,469,873 | 5/1949 | Ernest | 279/2.04 |
| 2,922,592 | 1/1960 | Kaltenbach . | |
| 3,420,537 | 1/1969 | Walters . | |
| 3,517,939 | 6/1970 | Jaehn . | |
| 3,648,942 | 3/1972 | Lercher et al. . | |
| 3,791,659 | 2/1974 | Hardin . | |
| 3,881,666 | 5/1975 | Greenhalgh . | |
| 4,284,251 | 8/1981 | Castillo . | |
| 4,715,553 | 12/1987 | Hatakeyama et al. . | |
| 4,795,106 | 1/1989 | Weiss et al. . | |
| 4,821,974 | 4/1989 | Poehlein . | |
| 4,903,910 | 2/1990 | Tamura | 242/571.3 |
| 4,971,265 | 11/1990 | Koch | 242/571.3 |
| 5,133,566 | 7/1992 | Baker . | |
| 5,613,692 | 3/1997 | Lloyd | 279/2.03 |

FOREIGN PATENT DOCUMENTS

| | | | |
|---|---|---|---|
| 31 16325 A1 | 4/1982 | Germany . | |
| 28 15310 C2 | 6/1982 | Germany . | |
| 63-71055 | 3/1988 | Japan | 242/571.3 |
| 1678549 A1 | 9/1991 | Russian Federation | 279/2.02 |

*Primary Examiner*—Donald P. Walsh
*Assistant Examiner*—William A. Rivera
*Attorney, Agent, or Firm*—Jenkens & Gilchrist

[57] ABSTRACT

A device for mounting a roll of material that includes a fiber core around which the material is placed. The device includes a lightweight, polymeric collett that is inserted into the fiber core. The polymeric collett has a plurality of individual segments that expand radially with respect to a central axis of the roll of material. Each of the plurality of individual segments includes an inner wall and an outer wall. The inner walls of the plurality of individual segments define a cavity. The outer walls engage an interior surface of the fiber core. An arbor engages the inner walls of the plurality of individual segments and forces them outwardly to place the outer walls into tight, frictional engagement with the interior surface of the fiber core.

29 Claims, 3 Drawing Sheets

EXPANDABLE FIBER CORE INSERT

RELATED APPLICATIONS

The application claims the benefit of U.S. Provisional Patent Application Ser. No. 60/025,764, filed Sep. 23, 1996.

FIELD OF THE INVENTION

The invention relates generally to rolls of wrapped material that have a hollow fiber core and, particularly, to an insert that is mounted within the hollow fiber core.

BACKGROUND OF THE INVENTION

The present invention solves a problem encountered by rolls of material, such as paper, that are wrapped around a hollow fiber core. The fiber core is typically made from pressed paperboard which has enough rigidity to support the rolled material. When placed on a machine which allows the rolled material to unwind, the fiber core is held and serves as the axis around which the roll of material rotates. Preferably, the unwinding process occurs with stability such that the only motion is rotational.

The manner in which the fiber core is held is critical to the performance of the unwinding process. Typically, a tapered chuck is inserted at each end of the hollow fiber core. The tapered chuck initially exerts a known amount of pressure at its contact points within the hollow fiber core. As the roll is rotated, the dynamic forces associated with the rotation are transferred through the hollow core and into the tapered chuck. Moreover, to maintain a constant rate at which the material is unwrapped, the roll must gradually increase its angular speed as more material is removed from the roll. Ultimately, the increased speeds and dynamic forces result in a marring of the inside surface of the hollow fiber core by the tapered chuck at the contact points. Eventually, the damage to the hollow fiber core may become so great that the severe wobbling of the roll is experienced which can result in a catastrophic failure. Considering that these rolls can weigh from several hundred pounds to several thousand pounds and are rotating at several hundred revolutions per minute, such a failure can result in extensive damage to the machinery and injury to personnel in the immediate area.

One solution to this problem has been to use large metal inserts that fit within the hollow fiber core. However, these metal inserts, which are usually made of steel, weigh thirty pounds or more and are, consequently, difficult to manually transport and position. Moreover, they are expensive since detailed machining is necessary for this insert to tightly fit within the core and perform the necessary process.

DETAILED DESCRIPTION OF THE INVENTION

Figure 1A:
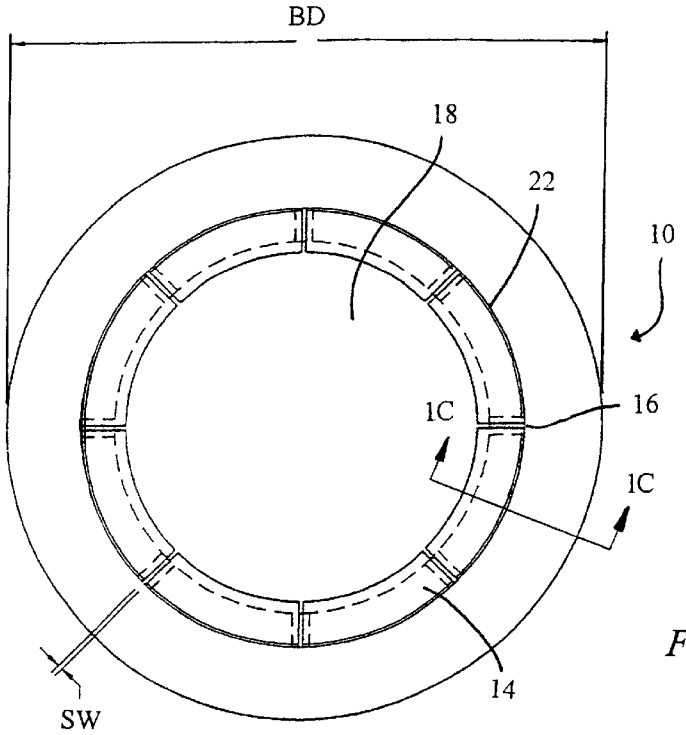
FIG. 1A is a side view of an end view of a collett used in the present invention.
Figure 1B:
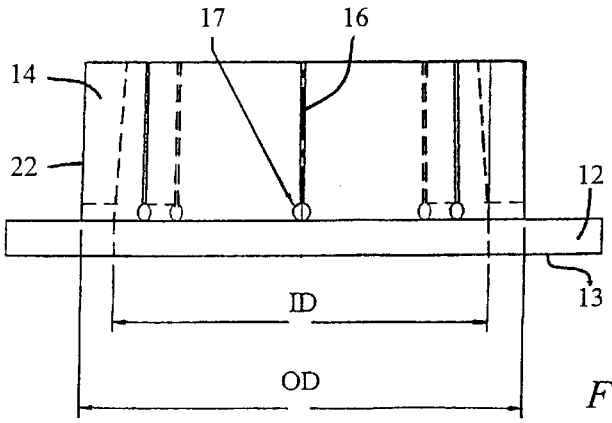
FIG. 1B is a plan view of the collett in FIG. 1A.
Figure 1C:
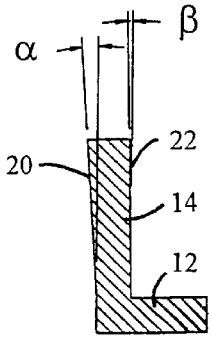
FIG. 1C is a cross-section of a portion of the collett taken along line 1C—1C in FIG. 1B.

Referring initially to FIGS. 1A–1C, a collett 10 includes a base portion 12 with a bottom surface 13. The base portion

12 has a base diameter BD which has a dimension that depends on the size of the hollow fiber core in which the collett 10 is to be inserted. Typically, the size of base diameter BD is less than or about equal to the outer diameter of the fiber core in which it is to be inserted.

A side wall 14 projects upwardly away from the base portion 12. The side wall 14 includes a series of slots 16 which continue substantially along the height of the side wall 14. As shown, there are eight slots 16 which segregate the side wall 14 into eight equal segments. At the bottom of each slot 16 is a gap 17 which is larger than the slot width SW to provide additional flexibility to the segments of the side wall 14. Again, the size of the slot width SW is dependent on the application but is generally between about 0.020 inch and about 0.100 inch. The need for flexibility in the side wall 14 is discussed below.

The collett 10 has an internal bore 18 which is defined by the side wall 14. The bore 18 is not completely cylindrical as is best seen by reviewing FIG. 1C which is a cross-section through the side wall 14 taken along line 1C—1C in FIG. 1A. The side wall 14 has an inner surface 20 and an outer surface 22 which are slightly off from being perpendicular with the base portion 12. The inner surface 20 extends from the base portion 12 at an angle $\alpha$ from the normal line and has an inner diameter ID adjacent to the base 12. In a preferred embodiment, angle $\alpha$ is in the range from about 2° to about 6°. Likewise, the outer surface 22 projects from the base portion 12 at an angle $\beta$ away from the normal line and has an outer diameter OD adjacent to the base 12. In a preferred embodiment, angle $\beta$ is the range from about 0.25° to about 4°. Consequently, the inner surface 20 which defines the bore 18 and the outer surface 22 both have a slight frustoconical shape.

Furthermore, angle $\alpha$ is larger than angle $\beta$ so that when the side wall 14 is forced out by the arbor 30 (described below with reference to FIGS. 2A–2B), the outer surface 22 will expand past the normal line relative to the base portion 12. This ensures that the outer surface 22 tightly engages the interior surface of the fiber core.

Figure 2B:
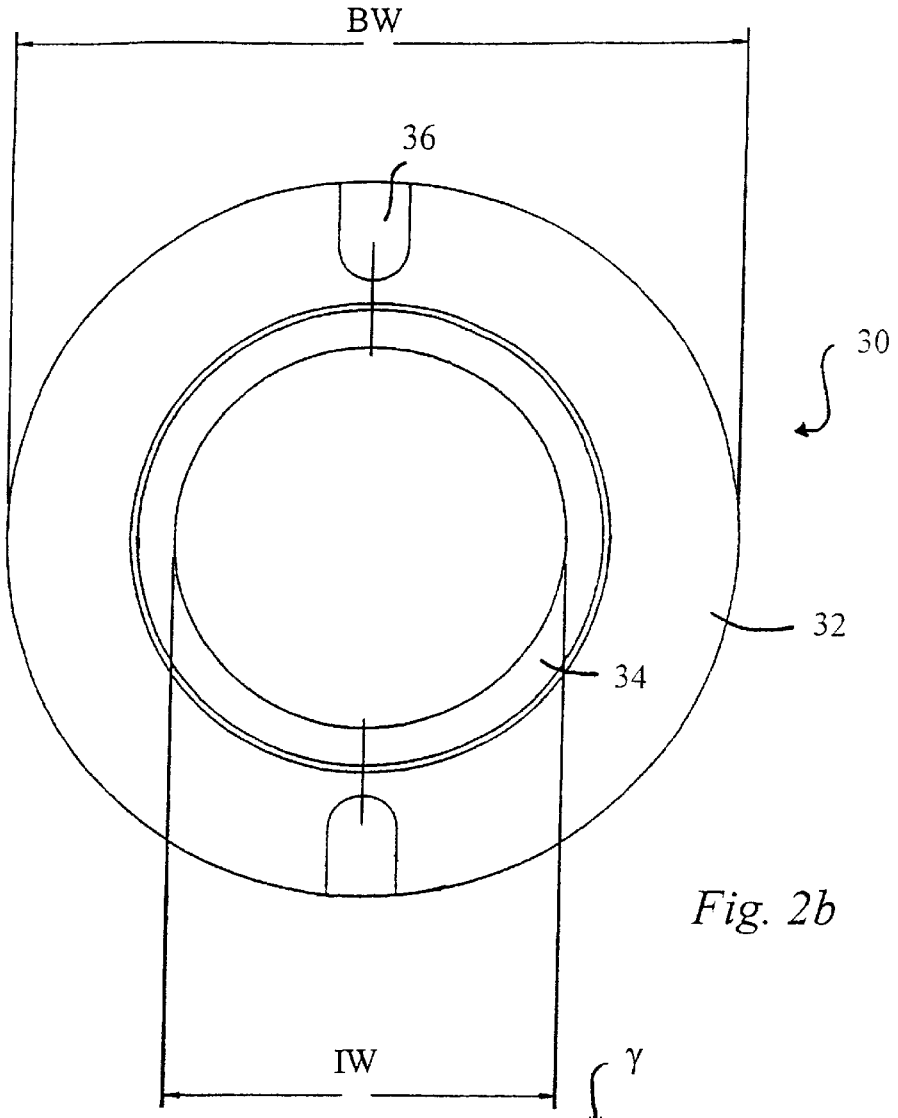
FIG. 2B is a plan view of the arbor in FIG. 2A.
Figure 2A:
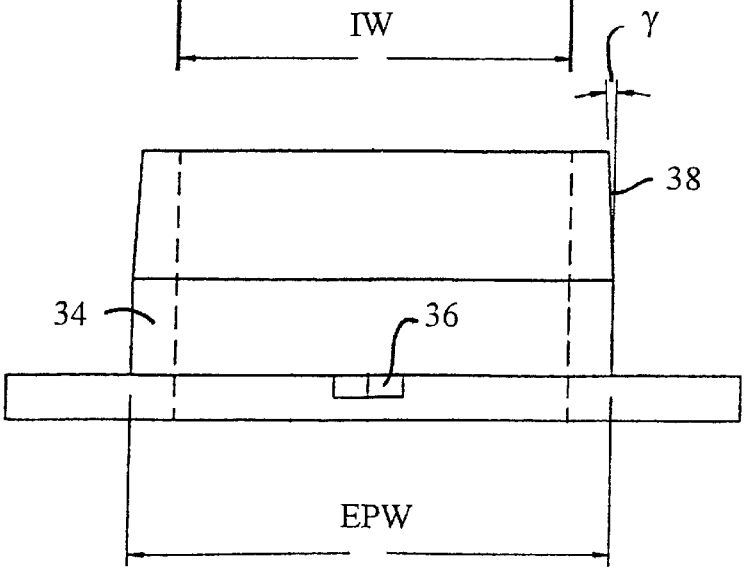
FIG. 2A is a side view of an arbor used in the present invention.

FIGS. 2A–2B illustrate an arbor 30 which cooperates with the collett 10 of FIGS. 1A–1C. The arbor 30 includes a circular bulkhead 32 that has a bulkhead width BW which is approximately the same size as the base diameter BD of the base 12 of the collett 10 in FIG. 1A. An expander projection 34 extends upwardly from the bulkhead 32 and includes an internal width IW and an expander projection width EPW. The expander projection 34 of the arbor 30, as will be described in detail below, is for engaging the outer surface 22 of the side wall 14 of the collett 10 so as to expand it into the fiber core 62. The arbor 30 also includes two slots 36 located on the bulkhead 32 which allow for the insertion of a tool to separate the collett 10 from the arbor 30, as is described below, if these two components remain engaged.

Like the side wall 14 of the collett 10 described above, the projection 34 includes a tapered portion 38. The tapered portion 38 typically extends along about half the height of the projection 34. The tapered portion 38 facilitates the insertion of the arbor 30 into the collett 10. The angle $\gamma$ at which the tapered portion 38 deviates from the normal line is usually in the range from about 1° to about 5°. This angle $\gamma$ is usually less than the angle $\alpha$ on the inner surface 20 as shown in FIG. 1C.

Figure 3:
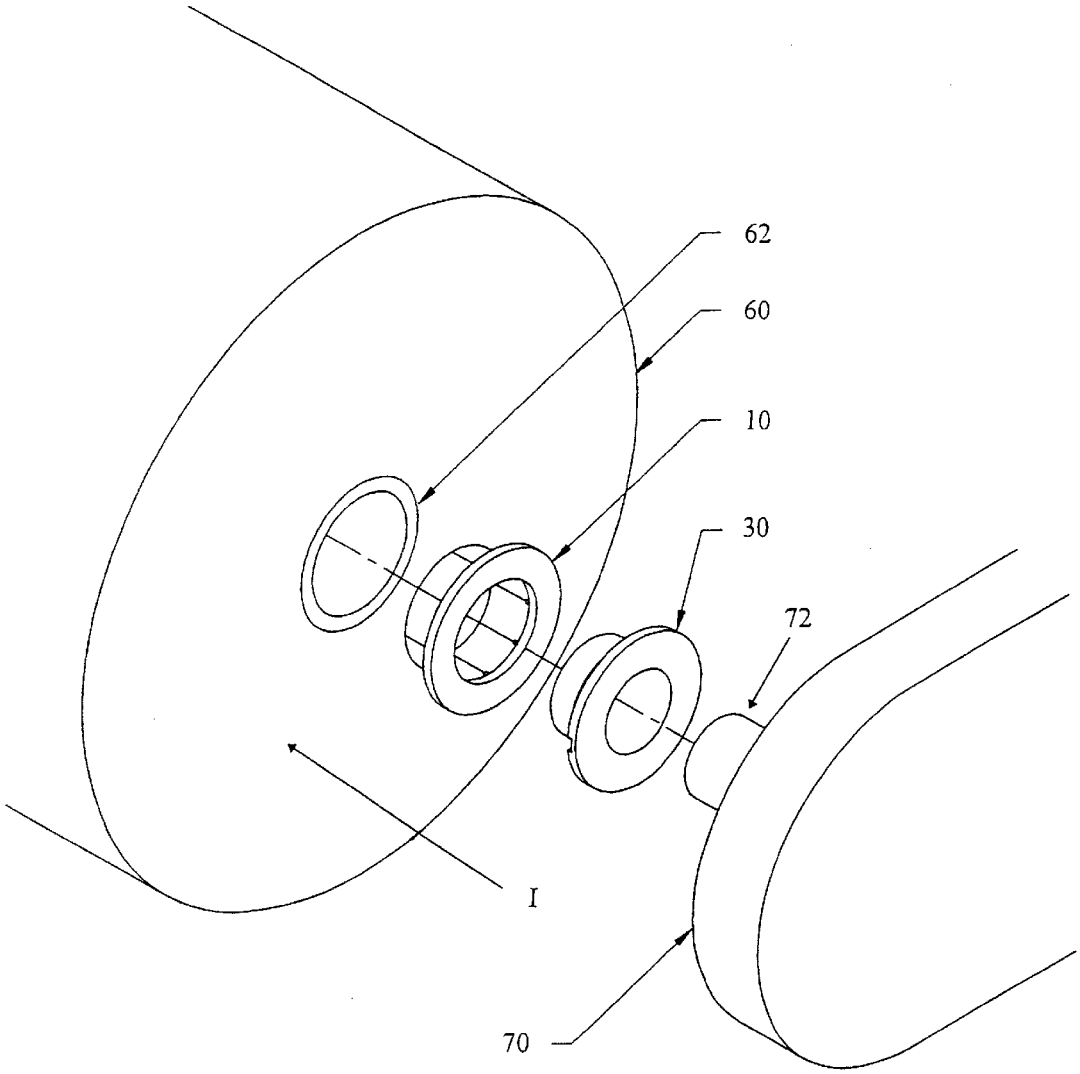
FIG. 3 is a perspective view of the arbor and collett being used on a paper roll assembly.

FIG. 3 illustrates the use of the collett 10 and the arbor 30 on a roll 60 of material that is, for example, paper. The roll 60 includes an inner fiber core 62 around which the material of the roll 60 is wrapped. The types of machinery which support the roll 60 and allow the roll 60 to rotate varies. However, each type of machinery must have a pair of supporting arms 70 on either side of the roll 60 which support the roll 60. And, each arm 70 must include a spindle 72 on which the roll 60 spins.

To assemble the components, the arbor 30 is mounted on the spindle 72. The collett 10 is then placed into the fiber core 62 which is facilitated by the outer surface 22 (FIGS. 1A–1C) of the collett 10 being tapered. The arm 70 on which the spindle 72 resides is then moved in the insertion direction denoted by arrow I toward the roll 60. The arbor 30, which is mounted on the spindle 72, is inserted into the bore 18 (FIGS. 1A–1C) of the collett 10 which is made easy due to the tapered portion 38 of the projection 34. The expander projection width EPW of the projection 34 of the arbor 30 is slightly smaller (e.g. about 0.002 inch to about 0.015 inch) than the inner diameter ID of the side wall 14. As the insertion process continues, the projection 34 engages the inner surface 20 of the side wall 14, which is tapered inwardly at angle $\alpha$, to force the outer surface 22 of the side wall 14 to tightly engage the inner surface of the hollow fiber core 62. The slots 16 and the larger gaps 17 at the bottom of the slots 16 provide flexibility to the side wall 14 in that they permit the radial outward movement of each segment of the side wall 12. The press-fit engagement between the outer surface 22 of the side wall 14 and the inner surface of the fiber core 62 is enough to sustain an appropriate contact pressure between the collett 10 and the fiber core 62 even when they are subjected to the strenuous dynamic forces of operation.

After a roll 60 has its wrapped material completely removed through the rotation of the roll 60, the arm 70 moves away from the fiber core 62. The tight engagement between the collett 10 and the fiber core 62 is then removed and the collett 10 can be pulled from the fiber core 62. If the collett 10 is not removable from the fiber core 62 by hand, then a simple tool, such as a screwdriver, can be used to pry the collett 10 from the fiber core 62. If the collett 10 remains on the arbor 30, then a simple tool, like the screwdriver, can be inserted into the slots 36 (FIGS. 2A–2B) to pry the collett 10 from the arbor 30.

The collett 10 is made of a durable polymeric material, such a nylon, which will not deform under the compressive stresses when it is pressed into the fiber core 62. Consequently, it is not heavy and poses no risk of injury when being transported, unlike current devices which perform a similar function that are made of steel and are, consequently, very heavy. Furthermore, if the collett 10 becomes damaged, then the damaged collett 10 can be recycled and replaced by a new collett 10. Because the colletts are made of a polymeric material such as nylon, they are easily manufactured and are, therefore, very inexpensive in comparison to comparable steel devices.

The arbor 30 is made of a metal, usually a hardened steel, which allows it to force the collett 10 into the fiber core 62 without the risk of being inelastically compressed during the process. Although the arbor 30 is metallic, and therefore heavier than the collett 10, it does not need to be removed each time a new roll 60 is to be mounted on the spindle 72. Consequently, once the arbor 30 is mounted on the spindle 72, it can be continuously inserted into and retracted from the fiber cores 62 of the rolls 60.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention.

What is claimed is:

1. A polymeric collett for use with a roll having a fiber core with material wrapped therearound, said collett comprising:

a base portion with a top surface, a bottom surface, and inner and outer surfaces extending between said top and bottom surfaces;

an expandable structure having a plurality of segments each of which is separated by a slot, each of said plurality of segments including an inner wall extending away from said top surface of said base portion adjacent to said inner surface and an outer wall extending away from said top at a position intermediate to said inner and outer surfaces, said outer walls have a slight taper to facilitate into said fiber core; and wherein said polymeric collett has a first orientation in which said outer walls of said plurality of segments are adjacent to an interior surface of said fiber core and a second orientation in which said outer walls are expanded radially outward with respect to a central axis of said fiber core so as to be in tight, frictional engagement with said interior surface of said fiber core.

2. The expandable polymeric collett of claim 1, wherein said inner walls extend away from said top surface at a first taper with respect to the normal in said first orientation, said first taper being in a direction away from said interior surface of said fiber core.

3. The expandable polymeric collett of claim 2, wherein said first taper is in the range from about 2° to about 6°.

4. The expandable polymeric collett of claim 2, wherein said slight taper of said outer walls is less then said first taper.

5. The expandable polymeric collett of claim 4, wherein said slight taper of said outer walls is in the range from about 0.25° to about 4°.

6. The expandable polymeric collett of claim 1, wherein said of each said slots have a width in the range from about 0.02 inch to about 0.10 inch.

7. The expandable polymeric collett of claim 1, wherein said collett is made of nylon.

8. The expandable polymeric collett of claim 1, further including a gap at the bottom of each of said slots, said gap having a width that is larger than a width of said corresponding slot to provide additional flexibility.

9. The expandable polymeric collett of claim 1, wherein said base portion has an annular profile.

10. The expandable polymeric collett of claim 1, wherein none of said slots extend completely through said collett.

11. The expandable polymeric collett of claim 1, wherein said base portion is continuous.

12. A device for insertion into a fiber core of a roll that has material wrapped therearound, said device comprising:

a collett having a plurality of expandable individual segments separated from each other by a plurality of slots, none of said slots extending completely through said collett, each of said segments includes an inner wall and an outer wall for insertion into said fiber core, said inner walls of said plurality of individual segments defining a cavity, said outer walls for engaging an interior surface of said fiber core, said expandable collett includes means for limiting the amount of insertion of said plurality of individual segments into said fiber core, each of said inner walls of said plurality of individual segments has a slight taper with respect to the normal to produce a slight conical shape to said cavity, and each of said outer walls of said plurality of individual segments also has a slight taper with respect to the normal, said slight taper of said outer walls being less than said slight taper of said inner walls; and an arbor for insertion into said cavity, said arbor having an engaging surface for engaging said inner walls of said plurality of individual segments to force said individual segments outwardly and place said outer walls into tight, frictional engagement with said interior surface of said fiber core.

13. The insertion device for fiber cores of claim 12, wherein said engaging surface includes a tapered portion.

14. The insertion device for fiber cores of claim 13, wherein said tapered portion of said engaging surface tapers at less of an angle with respect to the normal than said slight taper of said inner walls.

15. The insertion device for fiber cores of claim 14, wherein said tapered portion tapers at an angle with respect to the normal that is in the range from 1° to about 5°.

16. A device for insertion into a fiber core of a roll that has material wrapped therearound, said device comprising:

a collett having a plurality of expandable individual segments, each of which includes an inner wall and an outer wall for insertion into said fiber core, said inner walls of said plurality of individual segments defining a cavity, each of said inner walls of said plurality of individual segments has a slight taper with respect to the normal to produce a slight conical shape to said cavity, said outer walls for engaging an interior surface of said fiber core, said expandable collett includes means for limiting the amount of insertion of said plurality of individual segments into said fiber core, each of said outer walls of said plurality of individual segments also has a slight taper with respect to the normal, said slight taper of said outer walls being less than said slight taper of said inner walls; and an arbor for insertion into said cavity, said arbor having an engaging surface for engaging said inner walls of said plurality of individual segments to force said individual segments outwardly and place said outer walls into tight, frictional engagements with said interior surface of said fiber core.

17. The insertion device for fiber cores of claim 16, wherein said insertion limiting means of said collett is an annular base portion having maximum diameter larger than a diameter of said interior surface of said fiber core.

18. The insertion device for fiber cores of claim 17, wherein said annular base portion includes a top surface, a bottom surface, and inner and outer surfaces extending between said top and bottom surfaces.

19. The insertion device for fiber cores of claim 18, wherein each of said inner walls extends away from said top surface of said base portion adjacent to said inner surface and said outer wall extends away from said top surface at a position intermediate to said inner and outer surfaces.

20. The insertion device for fiber cores of claim 16, wherein said collett is made of a durable polymeric material.

21. The insertion device for fiber cores of claim 20, wherein said durable, polymeric material is nylon.

22. The insertion device for fiber cores of claim 16, wherein arbor is made of a metallic material.

23. The insertion device for fiber cores of claim 16, wherein said arbor includes means for assisting in the removal of said collett from said arbor.

24. A device for insertion into a fiber core of a roll that has material wrapped therearound, said device comprising:

a collett having a plurality of expandable individual segments, each of which includes an inner wall and an outer wall for insertion into said fiber core, said inner walls of said plurality of individual segments defining a cavity, said inner walls of said plurality of individual segments has a slight taper with respect to the normal to produce a slight conical shape to said cavity, said outer walls for engaging an interior surface of said fiber core, said expendable collett includes means for limiting the amount of insertion of said plurality of individual segments into said fiber core; and an arbor for insertion into said cavity, and arbor having an engaging surface for engaging said inner walls of said plurality of individual segments to force said individual segments outwardly and places said outer walls into tight, frictional engagement with said interior surface if said fiber core, said engaging surface includes a taper portion that tapers at less of an angle with respect to the normal than said slighter taper of said inner walls.

25. The insertion device for fiber cores of claim 24, wherein said slight tapered portion tapers at an angle with respect to the normal that is in the range from about 1° to about 5°.

26. A device for insertion into a fiber core of a roll that has material wrapped therearound, said device comprising:

a collett having a plurality of expandable individual segments, each of which includes an inner wall and an outer wall for insertion into said fiber core, said inner walls of said plurality of individual segments defining a cavity, said outer walls for engaging an interior surface of said fiber core, said expandable collett includes means for limiting the amount of insertion of said plurality of individual segments into said fiber core; and an arbor for insertion into said cavity, said arbor having an engaging surface for engaging said inner walls of said plurality of individual segments to force said individual segments outwardly and place said outer walls into tight, fictional engagement with said interior surface of said fiber core, said arbor includes means for assisting in the removal of said collett from said arbor.

27. A polymeric collett for use with a roll having a fiber core with material wrapped therearound, said collett comprising:

a base portion with a top surface, a bottom surface, and inner and outer surfaces extending between said top and bottom surfaces;

an expandable structure having a plurality of segments each of which is separated by a slot, each of said plurality of segments including an inner wall extending away from said top surface of said base portion adjacent to said inner surface and an outer wall extending away from said top surface at a position intermediate to said inner and outer surfaces;

wherein said polymeric collett has a first orientation in which said outer walls of said plurality of segments are adjacent to an interior surface of said fiber core and a second orientation in which said outer walls are expanded radially outward with respect to a central axis of said fiber core so as to be in tight, frictional engagement with said interior surface of said fiber core; and wherein said inner walls extend away from said top surface at a first taper with respect to the normal in said first orientation, said first taper being in a direction away from said interior surface of said fiber core, wherein said outer walls extend away from said top surface at a second taper with respect to the normal in said first orientation, said second taper being in a direction away from said interior surface of said fiber core, said second taper being less than said first taper.

28. The expandable polymeric collett of claim 27, wherein said first taper is in the range from about 2° to about 6°.

29. The expandable polymeric collett of claim 29, wherein said second taper is in the range from about 0.25° to about 4°.

* * * * *

UNITED STATES PATENT AND TRADEMARK OFFICE

CERTIFICATE OF CORRECTION

PATENT NO. : 6,123,285
DATED : September 26, 2000
INVENTOR(S) : Border et al.

It is certified that error appears in the above-identified patent and that said Letters Patent is hereby corrected as shown below:

Column 4,
Line 13, after "top" insert -- surface --
Line 15, after "facilitate" insert -- insertion --

Column 5,
Line 35, delete "engagements" and insert -- engagement --
Line 39, after "having" insert -- a --
Line 65, after "cavity," insert -- each of --

Column 6,
Line 1, delete "and" and insert -- said --
Line 4, delete "places" and insert -- place --
Line 5, delete "if" and insert -- of --
Line 63, delete "29" and insert -- 27 --

Signed and Sealed this

Twenty-ninth Day of July, 2003

JAMES E. ROGAN
*Director of the United States Patent and Trademark Office*